US010723596B2

(12) United States Patent
Schaal et al.

(10) Patent No.: US 10,723,596 B2
(45) Date of Patent: Jul. 28, 2020

(54) MODULAR CRANE, TRANSPORT UNIT FOR A MODULAR CRANE AND METHOD FOR OPERATING A CRANE OF THIS TYPE

(71) Applicant: Terex Global GmbH, Schaffhausen (CH)

(72) Inventors: Benjamin Schaal, Zweibrücken (DE); Klaus Meissner, Zweibrücken (DE); Rüdiger Zollondz, Greve (DK)

(73) Assignee: Terex Global GmbH, Schaffhausen (CH)

( * ) Notice: Subject to any disclaimer, the term of this patent is extended or adjusted under 35 U.S.C. 154(b) by 77 days.

(21) Appl. No.: 16/064,049

(22) PCT Filed: Dec. 19, 2016

(86) PCT No.: PCT/EP2016/081753
§ 371 (c)(1),
(2) Date: Jun. 20, 2018

(87) PCT Pub. No.: WO2017/108695
PCT Pub. Date: Jun. 29, 2017

(65) Prior Publication Data

US 2019/0002253 A1 Jan. 3, 2019

(30) Foreign Application Priority Data

Dec. 21, 2015 (DE) ..... 10 2015 226 314

(51) Int. Cl.
*B66C 23/36* (2006.01)

(52) U.S. Cl.
CPC .... *B66C 23/365* (2013.01); *B66C 2700/0371* (2013.01)

(58) Field of Classification Search
CPC ..... B66C 23/26; B66C 23/36; B66C 23/365; B66C 23/78; B66C 23/80
See application file for complete search history.

(56) References Cited

U.S. PATENT DOCUMENTS 3,101,150 A 8/1963 Arvid et al.
4,266,679 A * 5/1981 Juergens ..... B66C 23/78 180/9.1

(Continued)

FOREIGN PATENT DOCUMENTS

DE 102008047737 A1 4/2010
DE 102013009357 A1 12/2013

(Continued)

OTHER PUBLICATIONS

International Search Report of the International Searching Authority from corresponding Patent Cooperation Treaty (PCT) Application No. PCT/EP2016/081753, indicated dated Mar. 24, 2017.
Written Opinion of the International Searching Authority from corresponding Patent Cooperation Treaty (PCT) Application No. PCT/EP2016/081753, indicated dated Mar. 24, 2017.
International Preliminary Examination Report from corresponding Patent Cooperation Treaty (PCT) Application No. PCT/EP2016/081753, dated Mar. 27, 2018.

(Continued)

*Primary Examiner* — Michael R Mansen
*Assistant Examiner* — Juan J Campos, Jr.
(74) *Attorney, Agent, or Firm* — Gardner, Linn, Burkhart & Ondersma LLP

(57) ABSTRACT

A modular crane, with a pot-shaped element on which an upper carriage of the crane can be mounted such that it can rotate about a rotational axis, multiple support carriers hinged to the pot-shaped element such that they can each pivot about a pivot axis for support on the ground, and a separable driving base on which the pot-shaped element can be secured.

20 Claims, 6 Drawing Sheets

(56) References Cited

U.S. PATENT DOCUMENTS

| | | | | |
|---|---|---|---|---|
| 4,394,912 | A * | 7/1983 | Epps | B66C 23/78 212/303 |
| 4,394,913 | A * | 7/1983 | Lanning | B66C 23/78 212/304 |
| 8,282,130 | B2 * | 10/2012 | Fuegel | B62D 53/04 280/765.1 |
| 8,366,148 | B2 * | 2/2013 | Benz | B62D 21/186 280/763.1 |
| 9,377,032 | B2 * | 6/2016 | Fuegel | E04G 21/04 |
| 9,410,334 | B2 * | 8/2016 | Fugel | E04G 21/0436 |
| 2005/0211862 | A1 * | 9/2005 | Autenrieth | B66C 23/78 248/431 |
| 2007/0045212 | A1 * | 3/2007 | Riedinger | B62D 55/062 212/301 |
| 2018/0050891 | A1 | 2/2018 | Schaal et al. | |

FOREIGN PATENT DOCUMENTS

| | | | | |
|---|---|---|---|---|
| EP | 0919508 | A2 | 6/1999 | |
| EP | 1418151 | A1 * | 5/2004 | B66C 23/62 |
| EP | 1541520 | A1 * | 6/2005 | B66C 23/80 |
| EP | 1908723 | A1 * | 4/2008 | B66C 23/78 |
| EP | 2886505 | | 6/2015 | |

OTHER PUBLICATIONS

Preliminary Report on Patentability of the International Searching Authority in English from corresponding Patent Cooperation Treaty (PCT) Application No. PCT/EP2016/081753, English translation dated Mar. 27, 2018.

* cited by examiner

MODULAR CRANE, TRANSPORT UNIT FOR A MODULAR CRANE AND METHOD FOR OPERATING A CRANE OF THIS TYPE

CROSS REFERENCE TO RELATED APPLICATION

The present application claims the priority benefits of International Patent Application No. PCT/EP2016/081753, filed Dec. 19, 2016, and claims benefit of German patent application DE 10 2015 226 314.2, filed Dec. 21, 2015.

BACKGROUND OF THE INVENTION

The invention relates to a modular crane, a transport unit for a modular crane and a method of operating such a crane.

DE 10 2013 009 357 A1 discloses a modular mobile crane comprising a support which is transported to a construction site by means of a vehicle.

DE 10 2008 047 737 B4 discloses a mobile crane comprising a plurality of modular systems. In one embodiment, a platform module can have a carrier sub-module and two chassis frame sub-modules.

SUMMARY OF THE INVENTION

The object of the present invention is to improve a modular crane and to increase in particular the use variability of the modular crane.

In accordance with the invention, it has been recognised that a pot comprising support carriers pivotably articulated to an upper outer side of the pot via pivot joints can be transported in an advantageous manner with a drive base frame which can be divided into a front portion and a rear portion. The pot used is a substantially cylindrical component which is oriented in particular coaxially with respect to an axis of rotation, in relation to which a superstructure is rotatable with respect to a lower carriage. In particular, the support carriers are articulated in pivotable manner directly to the pot. The construction and in particular the modularity of the crane in accordance with the invention are simplified in comparison with the design comprising the carrier sub-module known from DE 10 2008 047 737 B4. The pot has, along the axis of rotation, a height which is increased with respect to the carrier sub-module known from the prior art. The pot serves to absorb and transfer loads from the superstructure to the base structure, i.e. the lower carriage, of the crane. The drive base frame is divisible in particular in a separation plane, wherein the separation plane is in particular perpendicular to a direction of travel of the drive base frame. The drive base frame can have a dedicated drive. The drive base frame can also be passive, e.g. designed as a trailer. The divisible design enables the drive base frame to advantageously integrate the pot with the support carriers. In the transport arrangement, the pot with the support carrier is part of the drive base frame. The pot serves to stabilise the drive base frame. In particular, transport on regular traffic routes, such as e.g. roads, rails and/or waterways is ensured The pot itself has connecting elements which are attached in the region of a lower end to its outer side, wherein the pot protrudes with its lower end together with the connecting elements underneath the support carrier. The support carriers remain articulated to the pot during transport. It is not necessary to remove the support carriers for transport purposes. The set-up outlay for the modular crane, in particular for a support device of the modular crane is reduced. Transport of the pot with the articulated support carriers is also ensured on a construction site. A construction site can have unsurfaced and/or uneven ground. The drive base frame is suitable in particular for cross-country drive. In particular, it has been recognised that a drive base frame does not have to be designed as a complete vehicle, such as that known from DE 10 2013 009 357 A1. The modular crane in accordance with the invention is simplified. The use variability of the modular crane is increased. The pot, on which a crane superstructure can be mounted so as to be able to rotate about an axis of rotation, and the support carriers used for providing support on the ground form a transport unit. The rotatable arrangement of the crane superstructure is provided with a rotary connection which is designed in particular as a roller rotary connection and is integrated in particular on the pot. The transport unit can be transported directly with the drive base frame without any further detachment, i.e. without the support carriers having to be removed from the pot. The transport unit fastened to the drive base frame is less than in particular a maximum permissible transport height which is a maximum of 4 m e.g. according to road traffic licensing regulations in Germany. The transport unit can be designed such that a maximum permissible transport width is observed. In this case, transport on roads is simplified, in particular this is possible without requiring additional licences. It is also possible for the transport unit to be designed with excess width. In particular, precisely four support carriers are articulated to the pot. Each support carrier is pivotable about a pivot axis. In particular, the pivot axes are each oriented in parallel with the axis of rotation. The axis of rotation and the pivot axes are oriented in particular perpendicularly to the ground. Provided that the ground is oriented horizontally, the pivot axes and the axis of rotation are oriented vertically. The modular crane comprising the pot, articulated support carriers and drive base frame permits the increase of the use of same parts between a pedestal crane (PC) and a terrain crane (TC). In particular, the transport unit can be used in an identical manner for the different crane designs PC and TC. The component outlay for the modular crane is reduced. The conversion from a PC to a TC can be performed in a quick and uncomplicated manner. In particular, the modular crane which is operated statically as a PC on the construction site can be moved as a TC on the construction site and on the road by means of the drive base frame.

A height of the support carriers which is less than a height of the pot and the articulation of the support carriers to an upper outer side of the pot according to an aspect of the present invention renders it possible to leave the support bars articulated to the pot during transport and thus to reduce the set-up outlay.

Telescopic support carriers according to a further aspect of the present invention allow the support surface to be enlarged in a direct and uncomplicated manner. The support carriers can be telescoped in particular along a longitudinal axis which is oriented in particular perpendicularly to the pivot axis of the support carrier.

A superstructure according to an aspect of the present invention ensures direct use of the crane.

A jib device according to yet a further aspect of the present invention allows the crane to perform lifting operations. The jib device comprises at least one main jib which can be designed in particular as a lattice mast jib or as a telescopic jib. The jib device further comprises at least one cable winch having a lifting cable and at least one lower block having a hook. If the crane is designed as a lattice mast crane, a raising block having a retraction mechanism together with a retraction mechanism cable is provided.

Counterweights can be provided on the crane superstructure. The counterweights can have a plurality of individual counterweights which in particular can be stacked one on top of the other. The jib device can have a super lift mast having a super lift cross member or counterweight carriage. If the crane is designed as a telescopic crane, a lateral super lift mast can be provided. The super lift cross member and/or the counterweight carriage serve to receive further counterweights. The super lift cross member can optionally be fastened to the super lift mast by means of lifting cylinders, whereby the height of the super lift cross member above the ground can be controlled. The height of the super lift cross member can be readjusted in particular in a mode of operation with a load on the hook. A luffable auxiliary jib can be articulated to the main jib. In this case, at least one luffing mechanism comprising a luffing cable is required. It is also possible to use a short rigid auxiliary jib without a luffing mechanism.

A connecting element according to an aspect of the invention ensures a direct, in particular a quick and uncomplicated, connection between the pot and drive base frame. The pot can be fastened directly to the drive base frame. The connection is releasable. The support carriers are indirectly connected to the drive base frame above the pot. The drive base frame has a connecting counter-element which corresponds to the connecting element of the pot.

A trailer as a drive base frame according to a further aspect of the invention ensures a particularly effective use of the drive base frame for transporting the transport unit, on the one hand, and as a trailer which can be towed if the crane is operated as a PC, on the other hand. The trailer can be towed by a towing vehicle. In particular, the trailer is a semi-trailer.

A divisible trailer according to an embodiment permits advantageous integration of the transport unit. In particular, the trailer can be separated in a direction transverse to the direction of travel. The trailer has a front trailer portion which is oriented in particular in the direction of travel, and a rear trailer portion which can be releasably connected thereto and is oriented in the direction of travel. Coupling elements of the trailer portions are designed such that they cooperate as connecting counter-elements with the connecting elements of the pot.

Drive axles according to a further aspect of the invention ensure independent mobility of the front and rear trailer portion. Each trailer portion has at least one drive axle. Each drive axle has in particular two wheels.

An arrangement of the pot according to an embodiment permits advantageous transport of the transport unit. The pot is arranged in particular in the direction of travel between the front and rear trailer portion. The pot is connected in particular directly to the front trailer portion and directly to the rear trailer portion. The pot and in particular the transport unit are an integral part of the drive base frame in this embodiment. In particular, the connecting elements and connecting counter-elements are arranged substantially in the plane of the bearing surface of the trailer. By integrating the pot into the drive base frame, the length of the drive base frame is increased with respect to an initial length of the drive base frame without a mounted pot. In particular, it has been recognised that it is advantageous not to place the transport unit on the trailer, in particular semi-trailer. The transport unit with the pot is arranged lower on the trailer for transport purposes. As a result, the available transport height can be utilised more effectively. A pot which can be transported in this manner, in particular a transport unit which can be transported in this manner can be of a taller design. In particular, taller support carriers can be articulated which thereby have an increased area moment of inertia and therefore contribute to improved stability and stiffness of the support carriers. The overall centre of gravity of the pot transported in this manner is arranged at a low position. The risk of the pot transported in this manner overturning, in particular during transport on unsurfaced terrain, in particular on a construction site, and in particular with the crane superstructure placed thereon, is reduced.

The drive base frame can also be designed as a modular vehicle according to another embodiment. The modular vehicle is also defined as a Self Propelled Modular Transporter (SPMT). The modular vehicle has at least two driven modules which can be connected to one another in particular in a releasable manner. A separation plane for releasably connecting the at least two modules is oriented in particular vertically to the direction of travel.

Modules according to an aspect of the invention permit stand-alone operation of the modular crane, in particular as a TC.

The releasable connection of the modules according to a further aspect of the invention ensures flexible adaptation of the drive base frame to external conditions. In particular, the number of drive axles can be adapted in dependence upon the weight to be transported and/or in dependence upon the ground surface. In particular, a crane operator who typically already has an SPMT can use this as a drive base frame for the modular crane. Plant investment is thereby reduced for the crane operator. The modular crane can be used cost-effectively for the crane operator. In particular, the pot is arranged in the direction of travel between the at least two modules.

A tensile element according to an embodiment of the invention improves the mechanical support of the crane because it permits the introduction of an adjustable, predetermined tension from the support carrier into the pot. The cause of this is an increase in the actual height hs of the support carrier 4 to a virtual height hv which can be used as the height for introducing and/or transferring a support force into the pot.

A transport unit according to an aspect of the invention permits a flexible and uncomplicated conversion of a PC to a TC.

A method according to as aspect of the invention is based upon the fact that the drive base frame is available for general transport tasks during operation of the crane as a PC. In particular, the drive base frame can be used as a counterweight carriage on the crane.

A further method in accordance with the invention is based upon the fact that the actual axle load can be variably adapted to the external conditions. In particular, the number of modules used can be varied in order to distribute the weight of the crane to, in particular more, axles.

Further advantageous embodiments, additional features and details of the invention will be apparent from the following description of exemplified embodiments with reference to the drawing.

DESCRIPTION OF THE PREFERRED EMBODIMENTS

Figure 1:
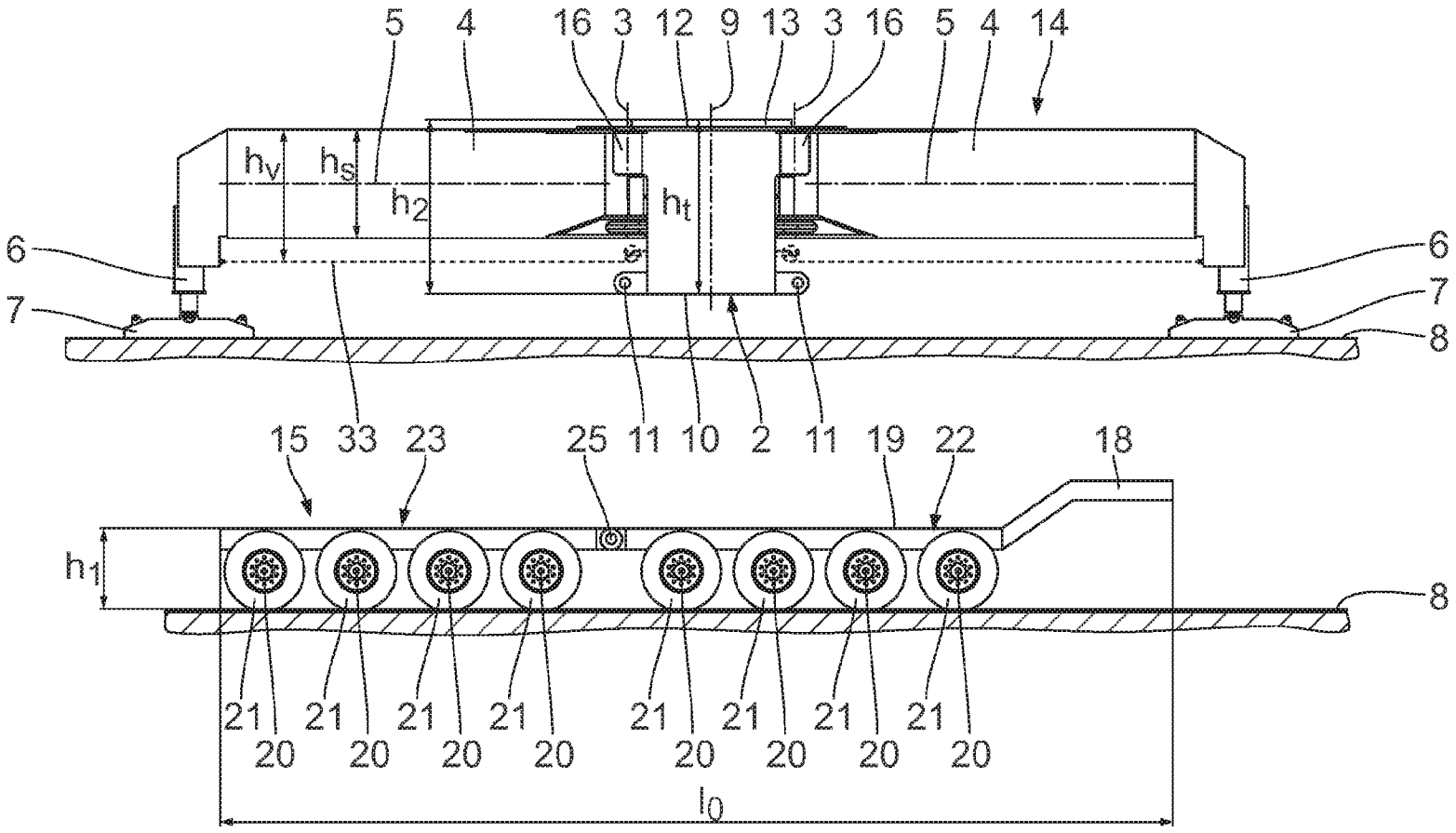
FIG. 1 shows a side view of a modular crane in accordance with the invention in a working arrangement.
Figure 2:
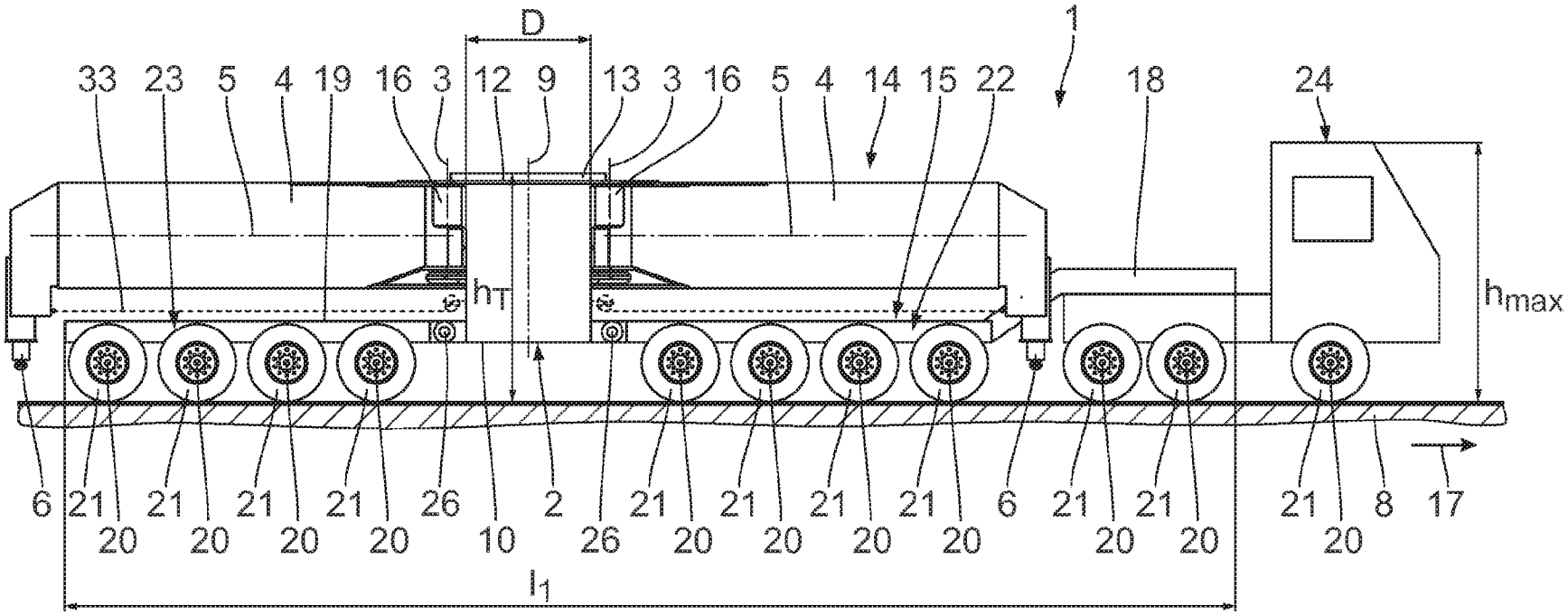
FIG. 2 shows a view, corresponding to FIG. 1, of the modular crane in a transport arrangement.
Figure 3:
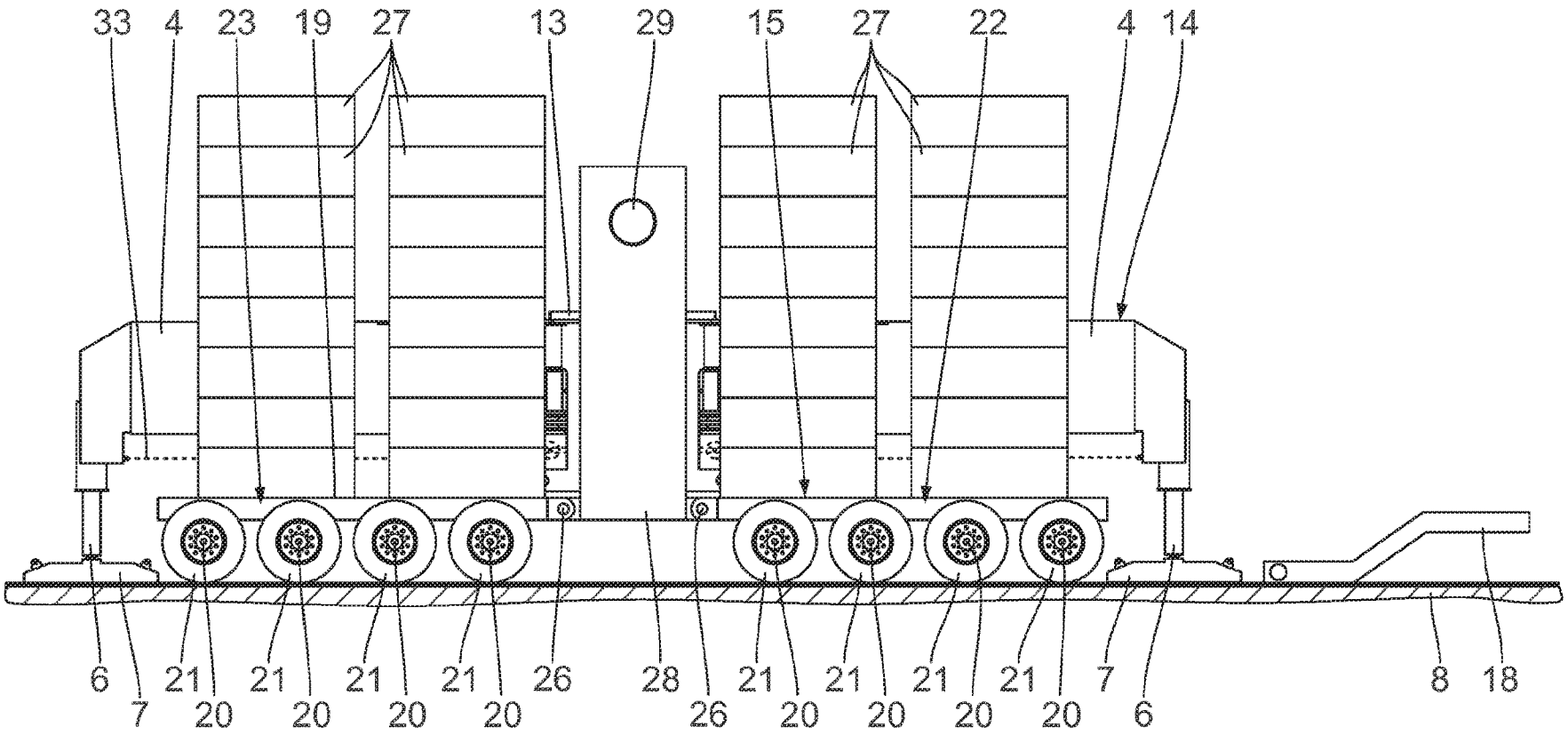
FIG. 3 shows a side view, corresponding to FIG. 1, of the modular crane of FIG. 1 for using the drive base frame as a counterweight carriage during crane operation.

A crane 1 which is illustrated in FIGS. 1 to 3 has a central pot 2, to which four support carriers 4 are articulated in each case so as to be able to pivot about a pivot axis 3. The support carriers 4 are designed substantially as a longitudinal profile having a longitudinal axis 5. In a plane perpendicular to the longitudinal axis 5, the support carriers 4 have a hollow profile form, in particular in the form of a rectangular hollow profile which is oriented upright, i.e. in which the height is greater than the width. The support carriers 4 can each be telescoped along the longitudinal axis 5. The support carriers 4 can be telescoped to one extent. The outer section of the telescopic support carrier 4 is articulated to the pot 2.

Guided at the end of the outer section remote from the pot 2 is an inner section which can be displaced with respect to the outer section along the longitudinal axis 5. At the end of the inner section remote from the pot 2 a height-adjustable support element 6 is formed, in particular as a hydraulic cylinder which ensures support on the ground 8 by means of a ground element 7. The ground elements 7 are designed in particular as static elements, in particular as support plates and/or pedestals. In the arrangement shown in FIG. 1, the crane is a static pedestal crane (PC). The ground 8 is substantially horizontal. The longitudinal axes 5 are oriented substantially in parallel with the ground 8, i.e. horizontally. The pivot axes 3 are oriented in parallel with one another and in particular perpendicularly to the respective longitudinal axis 5.

According to the exemplified embodiment shown, the height $h_s$ of the support carriers 4 is less than the height $h_T$ of the pot 2. In each case, a tensile element 33 is provided in order to introduce an adjustable, predetermined tension from the support carrier 4 into the pot 2. In particular, the tensile element 33 serves to introduce the tensile stress at a lower end of the pot 2, in particular in the region of the connecting elements 11. According to the exemplified embodiment shown, the tensile element 33 is designed as a cable comprising a winch. The tensile element 33 used can also be a cylinder, in particular a hydraulic cylinder or a threaded rod. In connection with the tensile element 33 the actual height hs of the support carrier 4 can be increased to a virtual height $h_v$. The virtual height $h_v$ corresponds to the height which can be used for introducing and/or transferring a support force into the pot 2. The support is mechanically improved. The following applies: $h_v > h_s$, in particular $h_v > 1.05 \times h_s$ and in particular $h_v > 1.2 \times h_s$.

The pot 2 is substantially cylindrical and has an axis of rotation 9. The axis of rotation 9 is oriented in parallel with the pivot axes 3.

A plurality of connecting elements 11, in particular at least two, are provided in the region of the lower end 10 of the pot 2 on an outer cylinder barrel wall of the pot 2. A roller rotary connection 13 is provided at an upper end 12 which is arranged on the pot 2 opposite the lower end 10 along the axis of rotation 9. The roller rotary connection 13 is arranged on the pot 2 concentrically to the axis of rotation 9. A crane superstructure, not illustrated, comprising a jib device, not illustrated, can be fastened to the pot 2 by means of the roller rotary connection 13. The crane superstructure is arranged in particular on the pot 2 in such a manner as to be able to rotate about the axis of rotation 9.

Arranged on an outer side of the pot 2 are pivot joints 16, to which the support carriers 4 are each pivotably articulated. The pivot joints 16 determine the pivot axis 3 in each case. The four pivot joints 16 are arranged equally spaced apart along the outer periphery on the pot 2, i.e. are arranged spaced apart from one another at a 90° spaced interval in relation to a rotation about the axis of rotation 9. In one support arrangement of the crane 1, the support carriers 4 are arranged radially in relation to the axis of rotation 9. In one transport arrangement, two adjacent support carriers 4 are each folded in pairs so that their spaced interval is minimal and in particular is zero. In this transport arrangement shown in FIG. 2, a pair of support carriers 4 extends in each case in the direction of travel 17 of the crane 1.

The pot 2 with the pivotably articulated support carriers 4 forms a transport unit 14. In particular, the ground elements 7 are not part of the transport unit 14. The transport unit 14 can be transported by means of a drive base frame 15. The drive base frame 15 and the transport unit 14 form the modular crane. The transport unit 14 can be connected to the drive base frame 15 in particular via the pot 2. In particular, the pot 2 can be fastened to the drive base frame 15.

The drive base frame 15 is designed as a trailer in the form of a semi-trailer. For this purpose, the trailer has a drawbar 18 and a loading surface 19. The loading surface 19 is a bearing surface. Objects to be transported can be placed on the bearing surface. The drive base frame 15 has a total of eight drive axles 20, wherein two wheels 21 are arranged on each drive axle 20. The trailer is designed to be divisible. The trailer has a front trailer portion 22 oriented in the direction of travel 17 and a rear trailer portion 23 oriented in the direction of travel 17. The front trailer portion 22 faces towards the drawbar 18. The front trailer portion 22 faces towards a towing vehicle 24 which serves to tow the trailer. The trailer can be fastened to the towing vehicle 24 by means of the drawbar 18. In particular, the towing machine 24 is not part of the drive base frame 15.

The front trailer portion 22 and the rear trailer portion 23 each have coupling elements 25. The coupling elements 25 can be used to connect the trailer portions 22, 23 to one another to form the drive base frame 15. The coupling elements 25 are designed such that they are also suitable for connecting the front and rear trailer portion 22, 23 to the connecting elements 11 of the pot 2. The coupling elements 25 are connecting counter-elements which correspond to the connecting elements 11. In particular, the connecting elements 11 and the connecting counter-elements 25 are designed as connecting plates which can be connected to one another by means of a transverse bolt 26. In the arrangement of the unloaded drive base frame 15, it has a length $l_0$.

For transporting the transport unit 14, the connection between the two trailer portions 22, 23 is released. The transport unit 14 is inserted in the direction of travel 17 between the two trailer portions 22, 23 and the two trailer portions 22, 23 are each fastened to one side of the pot 2. The trailer portions are fastened by introducing the transverse bolts 26 into the aligned openings of the connecting elements 11 of the pot 2 and the coupling elements 25 of the trailer portions 22, 23. It is thus essential that the pot 2 and thus the entire transport unit 14 is placed on the loading surface 19 of the drive base frame 15 and is fastened at that location. The pot 2 with the connecting elements 11 is integrated into the divided trailer. The pot 2 has become an integral part of the drive base frame 15. In the transport arrangement shown in FIG. 2, the length $l_1$ of the trailer is increased, in particular by the diameter D of the pot 2. In particular, the following applies: $l_1 > l_0$.

In particular, for transport on roads a maximum permissible transport height is to be observed for a transport vehicle. On roads in Germany, this maximum permissible transport height is 4 m. In Germany, a maximum permissible vehicle height must not exceed 4 m so that unrestricted transport on roads, in particular under bridges, is possible. According to the exemplified embodiment shown in FIG. 2, the maximum vehicle height is specified by the towing vehicle 24, in particular by the driver's cab. According to the exemplified embodiment, the maximum vehicle height $h_{max}$ is selected such that unrestricted use of the road traffic routes is possible. By virtue of the fact that the transport unit 14 is not placed down on the loading surface 19 and fastened at that location but instead is integrated into the loading surface 19, the height of the transport unit 14 with the drive base frame 15 can be reduced overall. In particular, its transport height $h_r$ is not derived from the sum of the height tu of the loading surface 19 and $h_2$ of the transport unit 14, in particular of the pot 2. In particular, the following applies: $h_r<h_t+h_2$. According to the exemplified embodiment shown, the transport height $h_T$ is less than the maximum vehicle height $h_{max}$. The transport height $h_r$ can be increased such that it corresponds to the maximum vehicle height $h_{max}$. The following then applies: $h_r=h_{max}$. In this case, it is therefore impossible that the pot 2 with the drive base frame 15 fully utilises the maximum permissible height for transport on roads. In particular, the pot 2 with the articulated support carriers 4 can fully utilise the available transport volume, in particular its height, of the transport unit 14.

FIG. 3 shows a possible advantageous use of the drive base frame 15 during use of the crane. The crane is reliably supported on the ground 8 via the support carriers 4, the support elements 6 and the ground elements 7. The drive base frame 15 serves as a counterweight carriage. For this purpose, individual counterweights 27 are stacked one on top of the other in a total of four stacks on the loading surface 19. The counterweight carriage can be moved by means of the wheels 21. In the case of the counterweight carriage, the front trailer portion 22 and the rear trailer portion 23 are connected to one another by means of a counterweight carriage connecting element 28. The counterweight carriage connecting element 28 has connecting elements 11 which correspond to the coupling elements 25 and can be designed substantially identically to the connecting elements 11 of the pot 2. At an upper end opposite the loading surface 19, the counterweight connecting element 28 has a bracing connection 29. The bracing connection 29 serves to articulate a bracing of the crane superstructure which is not illustrated in FIG. 3. The bracing connection 29 can be designed e.g. as a bolt perpendicular to the plane of the drawing according to FIG. 3 or as a through-going opening in the counterweight carriage connecting element 28.

The drawbar 18 is not required for using the drive base frame 15 as a counterweight carriage. As shown in FIG. 3, the detachable drawbar 18 can be detached from the front trailer portion 22.

A substantial advantage of the crane in accordance with the invention resides in the fact that transport of the crane, i.e. the transport unit 14 connected to the drive base frame 15, is ensured by the provision of a towing vehicle, wherein the towing vehicle must tow merely the trailer, i.e. the drive base frame 15. A separate independent vehicle is not required. By reason of the, in particular divisible, design of the trailer, the pot 2 and thus the transport unit 14 as a whole can be advantageously combined with the drive base frame 15.

Figure 4:
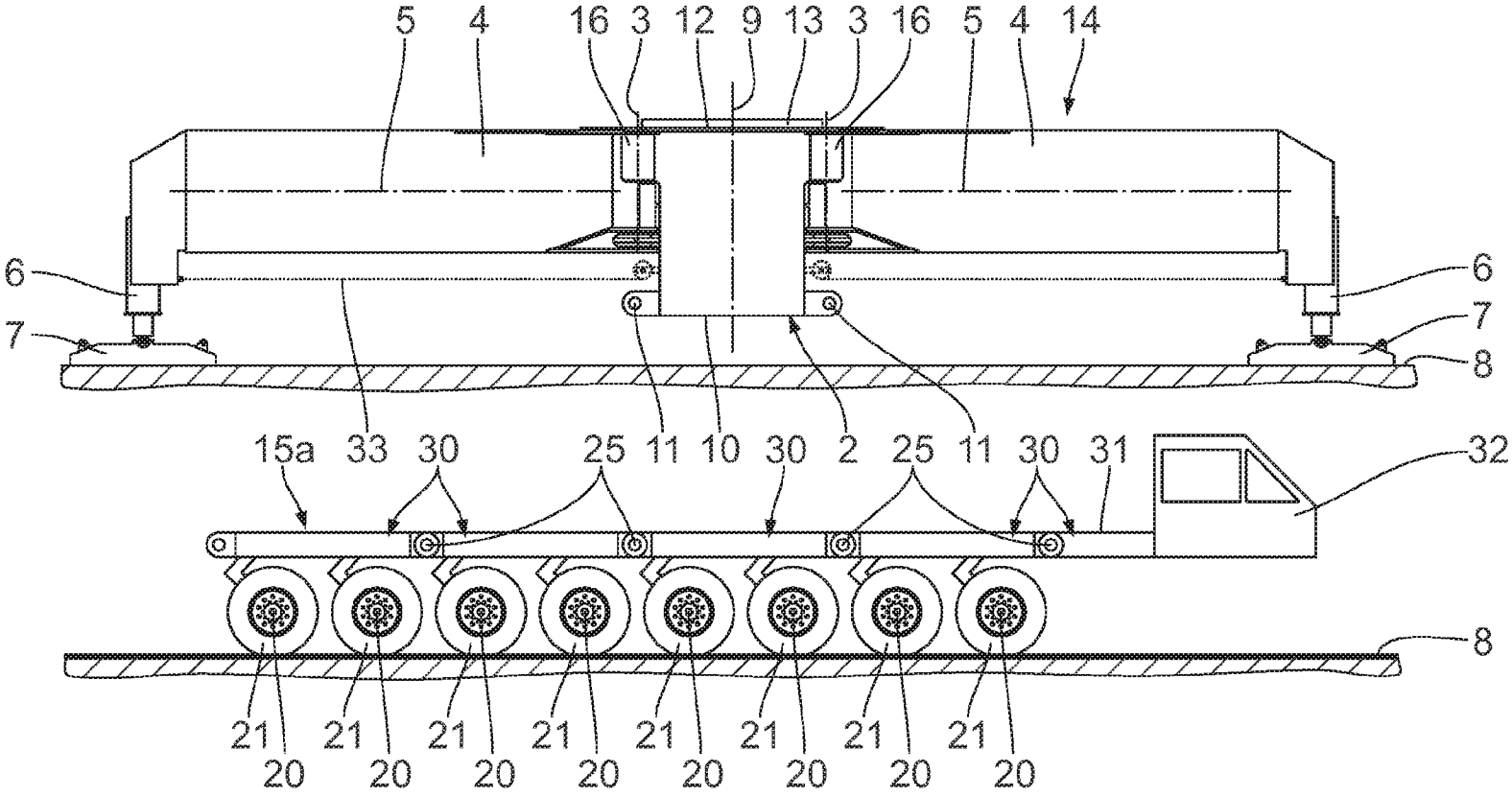
FIGS. 4 to 6 show views, corresponding to FIGS. 1 to 3, of a modular crane according to a further embodiment.
Figure 5:
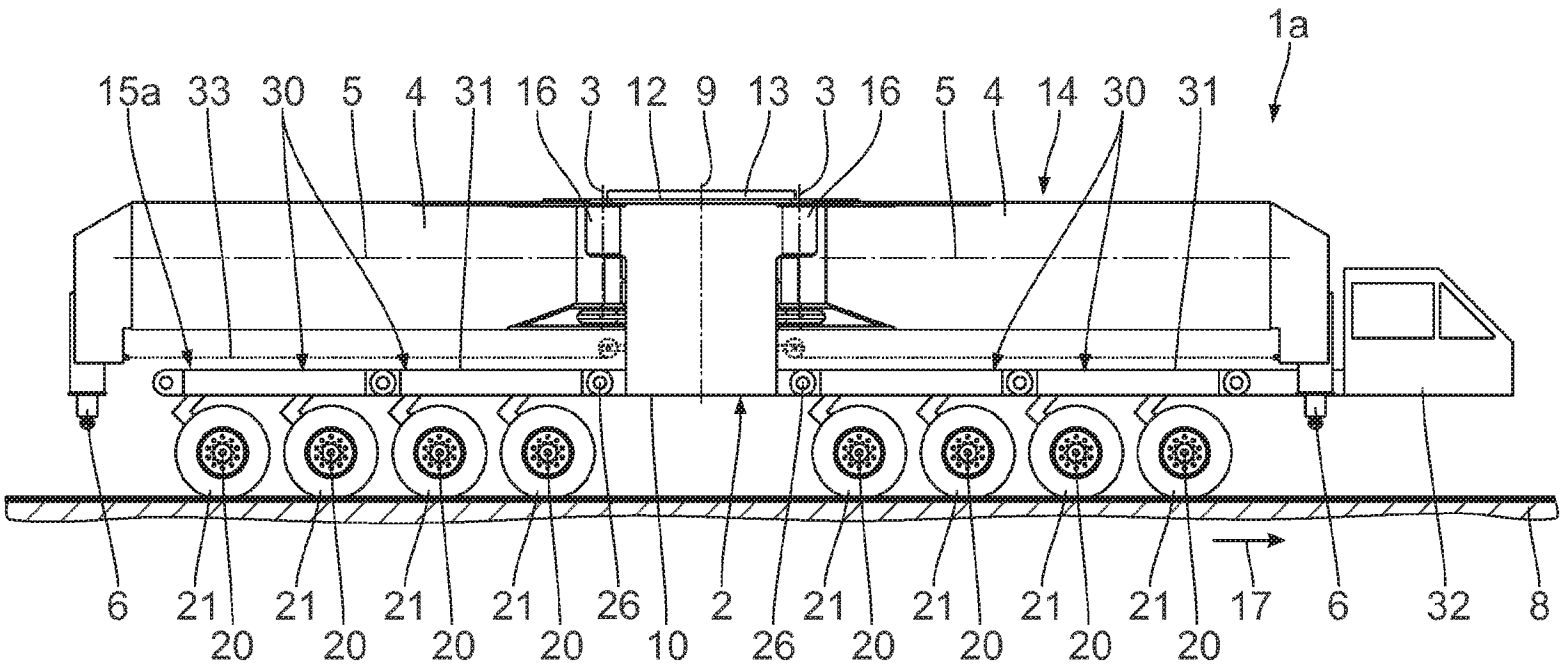
Figure 6:
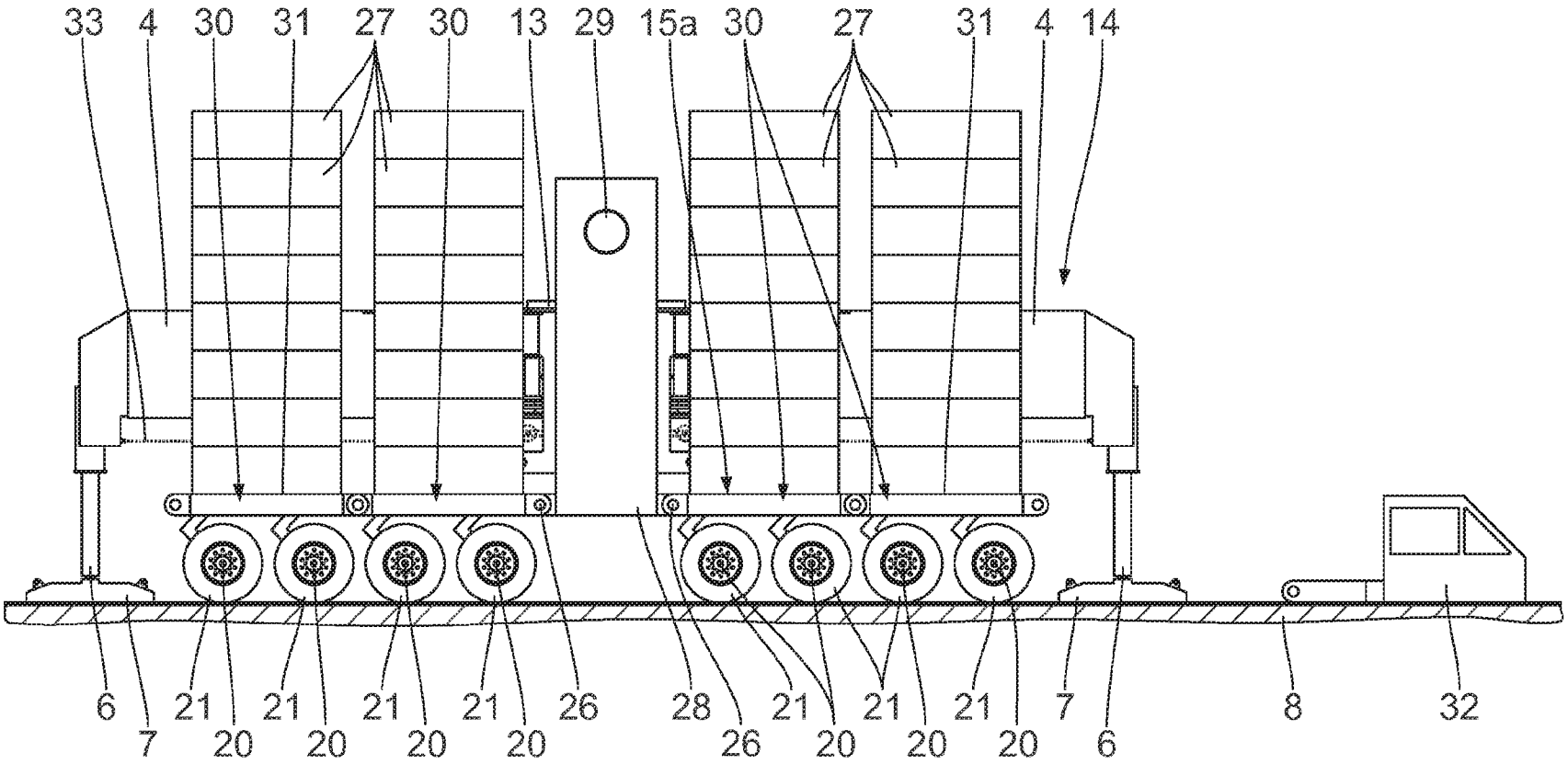

A further embodiment of the invention will be described hereinafter with reference to FIGS. 4 to 6. Structurally identical parts are designated by the same reference signs as in the first embodiment, the description of which is hereby referred to. Structurally different but functionally similar parts are designed by the same reference signs suffixed by the letter a.

The substantial difference in the crane 1*a* resides in the design of the drive base frame 15*a*. The drive base frame 15*a* is designed as a modular vehicle in the form of an SPMT. According to the exemplified embodiment shown, the modular vehicle has four identically designed modules 30. Each of the modules 30 has an upper platform 31, two drive axles 20 and a travel drive, not illustrated. The travel drive cooperates with at least one of the drive axles 20 in order to drive the wheels 21. A connecting element 11 and a connecting counter-element 25 are each provided on the platforms 31 of the modules 30. The modules 30 can be arranged one behind the other in the direction of travel 17 and can be connected to one another. This renders it possible to form a drive base frame 15*a* of substantially any length, by adding additional modules 30. The length of the drive base frame 15*a* can be variably adapted.

The transport unit 14 is unchanged with respect to the first embodiment.

A driver's cabin 32 is arranged on the foremost module 30 in the direction of travel 17. The driver's cabin 32 is not required for operating the drive base frame 15*a*. Nevertheless, the driver's cabin 32 can simplify the mobility of the drive base frame 15*a* e.g. on a construction site. In order to transport the transport unit 14, the drive base frame 15*a* can be divided at one of the connection points between two adjacent modules 30 and the transport unit 14 with the pot 2 can be inserted in the manner described with reference to the previous exemplified embodiment. According to the exemplified embodiment in FIG. 5, the pot 2 is inserted centrally, i.e. between two front modules 30 and two rear modules 30. However, such a symmetrical division of the modules 30 in relation to the axis of rotation 9 of the pot 2 is not compulsory.

The use of the drive base frame 15 as a counterweight carriage corresponds to that as per the drive base frame 15. In this case, it is also essential that the counterweight carriage connecting element 28 is integrated between the modules 30. When the drive base frame 15*a* is used as a counterweight carriage, it is advantageous if the counterweight carriage connecting element 28 is arranged symmetrically between the modules 30 in relation to the direction of travel 17.

The driver's cabin 32 is not required for using the drive base frame 15*a* as a counterweight carriage. Accordingly, the detachable driver's cabin 32 shown in FIG. 6 is detached from the modules 30.

The invention claimed is:

1. A modular crane, said modular crane comprising:

a pot configured to receive a crane superstructure mounted to the pot so as to be rotatable about an axis of rotation, wherein the pot has connecting elements that are releasably connected to a connecting counter-element of a drive base frame and wherein the drive base frame is configured to be divided into a front portion and a rear portion;

a plurality of support carriers, wherein the support carriers are articulated to an outer upper side of the pot so as to be pivotable in each case about a pivot axis via pivot joints for providing support on the ground;

wherein the pot protrudes with a lower end and the connecting elements, which are attached in the region of the lower end to an outer cylinder barrel wall of the pot, underneath the support carriers, and wherein a height of the support carriers is less than a height of the pot.

2. The modular crane as claimed in claim 1, wherein the support carriers are telescopable along a longitudinal axis.

3. The modular crane as claimed in claim 1, wherein a crane superstructure is rotatably mounted on the pot.

4. The modular crane as claimed in claim 3, wherein a jib device is arranged on the crane superstructure.

5. The modular crane as claimed in claim 1, wherein the drive base frame is designed as a trailer configured to be towed by a towing vehicle.

6. The modular crane as claimed in claim 5, wherein the trailer has a front trailer portion and a rear trailer portion that can be releasably connected thereto.

7. The modular crane as claimed in claim 6, wherein the front trailer portion and the rear trailer portion each have at least one drive axle.

8. The modular crane as claimed in claim 6, wherein the pot is connectable to the front trailer portion and to the rear trailer portion, and wherein the pot is arranged between the front trailer portion and the rear trailer portion.

9. The modular crane as claimed in claim 1, wherein the drive base frame is designed as a modular vehicle, and wherein the modular vehicle has at least two driven modules.

10. The modular crane as claimed in claim 9, wherein each module has a platform, a drive axle and a travel drive.

11. The modular crane as claimed in claim 10, wherein the modules are configured to be releasably connected to one another, and wherein the pot is arranged between two modules in a direction of travel.

12. The modular crane as claimed in claim 1, further comprising at least one tensile element for introducing an adjustable, predetermined tension from the support carrier into the pot, wherein each tensile element is disposed between and operatively connected with a selected one of the support carriers and the pot.

13. The modular crane as claimed in claim 1, wherein the modular crane comprises a transport unit.

14. A method of operating a modular crane, comprising the method steps of:

providing a modular crane as claimed in claim 1;

supporting the pot on the ground by the support carriers;

releasing the drive base frame from the pot; and using the drive base frame for transport tasks during crane operation.

15. The method of operating a modular crane as claimed in claim 14, wherein the drive base frame comprises a modular vehicle having at least one module with each module having at least one axle, and wherein the method further comprises adapting an actual axle load by varying the number of modules.

16. A modular crane, said modular crane comprising:

a pot to which a crane superstructure is rotatably mounted so as to be rotatable about an axis of rotation, wherein the pot has connecting elements that are releasably connected to a connecting counter-element of a drive base frame and wherein the drive base frame is configured to be divided into a front portion and a rear portion;

a plurality of support carriers, wherein the support carriers are articulated to an outer upper side of the pot so as to be pivotable in each case about a pivot axis via pivot joints for providing support on the ground, and wherein the support carriers are telescopable along a longitudinal axis;

wherein the pot protrudes with a lower end and the connecting elements, which are attached in the region of the lower end to an outer cylinder barrel wall of the pot, underneath the support carriers, and wherein a height of the support carriers is less than a height of the pot.

17. The modular crane as claimed in claim 16, wherein the drive base frame is designed as a trailer configured to be towed by a towing vehicle, and wherein the trailer has a front trailer portion and a rear trailer portion that can be releasably connected thereto.

18. The modular crane as claimed in claim 17, wherein the front trailer portion and the rear trailer portion each have at least one drive axle, and wherein the pot is connectable to the front trailer portion and to the rear trailer portion and the pot is arranged between the front trailer portion and the rear trailer portion.

19. The modular crane as claimed in claim 16, wherein the drive base frame is designed as a modular vehicle, and wherein the modular vehicle has at least two driven modules with each module having a platform, a drive axle and a travel drive, and wherein the modules are configured to be releasably connected to one another and the pot is arranged between two modules in a direction of travel.

20. The modular crane as claimed in claim 16, further comprising at least one tensile element for introducing an adjustable, predetermined tension from the support carrier into the pot, wherein each tensile element is disposed between and operatively connected with a selected one of the support carriers and the pot, and wherein the tensile element comprises a cable, a hydraulic cylinder or a threaded rod.

* * * * *